US006025100A

United States Patent [19]

Verschueren et al.

[11] Patent Number: 6,025,100

[45] Date of Patent: Feb. 15, 2000

[54] IMAGE RECEIVING LAYER FOR USE IN NON-IMPACT PRINTING

[75] Inventors: Eric Verschueren, Merksplas; Guido Hauquier, Nijlen; Jean Van Trier, Sint-Amands; Willem Cortens, Booischot, all of Belgium

[73] Assignee: Agfa-Gevaert, N.V., Mortsel, Belgium

[21] Appl. No.: 09/042,465

[22] Filed: Mar. 16, 1998

Related U.S. Application Data

[60] Provisional application No. 60/045,090, Apr. 29, 1997.

[30] Foreign Application Priority Data

Mar. 21, 1997 [EP] European Pat. Off. ..... 97200854

[51] Int. Cl.[7] ..... G03G 13/26

[52] U.S. Cl. ..... 430/49; 428/195

[58] Field of Search ..... 428/195; 430/49

[56] References Cited

U.S. PATENT DOCUMENTS

| | | | |
|---|---|---|---|
| 4,420,528 | 12/1983 | Okiyama | 428/220 |
| 5,834,397 | 11/1998 | Yamazaki et al. | 428/195 |

FOREIGN PATENT DOCUMENTS

| | | |
|---|---|---|
| 0 488 437 A1 | 6/1992 | European Pat. Off. . |
| 0 701 179 A2 | 3/1996 | European Pat. Off. . |
| 0 701 179 A3 | 3/1996 | European Pat. Off. . |
| 0 742 107 A2 | 11/1996 | European Pat. Off. . |
| 1 413 201 | 11/1975 | United Kingdom . |

OTHER PUBLICATIONS

Patent Abstracts of Japan, vol. 7, No. 38 (P–176), Feb. 16, 1983 and JP 57 190955A (Ajia Genshi), Nov. 24, 1982.

Patent Abstracts of Japan, vol. 7, No. 198 (P–220), Sep. 2, 1983 and JP 58 097055 A (Teijin), Jun. 9, 1983.

*Primary Examiner*—John Goodrow
*Attorney, Agent, or Firm*—Breiner & Breiner

[57] ABSTRACT

An image receiving layer for use in non-impact printing, especially in an electrostatographic printing method, is provided with an image receiving surface having a specified ratio between average and maximum roughness and a specified kinetic coefficient of friction against rubber with shore hardness 70. The receiving layer is especially well suited for producing lithographic printing plates with non-impact printing, especially with electrostatographic means.

11 Claims, No Drawings

IMAGE RECEIVING LAYER FOR USE IN NON-IMPACT PRINTING

This application claims the benefit of U.S. Provisional Application Serial No. 60/045,090 filed Apr. 29, 1997.

FIELD OF THE INVENTION

The present invention relates to an image receiving layer useful for producing lithographic printing plates by non-impact printing techniques. It relates especially to a toner receiving layer useful for producing lithographic printing plates by electrophotographic imaging.

BACKGROUND OF THE INVENTION

Lithography is the process of printing from specially prepared surfaces, some areas of which are capable of accepting lithographic ink, whereas other areas, when moistened with water, will not accept the ink. The areas which accept ink form the printing image areas and the ink-rejecting areas form the background areas.

In the art of making lithographic printing plates the demand for dry methods to prepare printing plates is ever increasing. Therefore the preparation of such printing plates via non-impact printing (e.g. via ink-jet printing, ionography, magnetography and especially electro(stato) graphy) has received and still receives great interest.

Generally, three different types of lithographic printing plates prepared by electro(stato)graphy have evolved.

One type of printing plate is produced by the following steps:

(i) uniformly electrostatically charging a photoconductive layer, such as a coating of zinc oxide photoconductive pigment dispersed in a resin binder, by means of a corona-discharge, (ii) image-wise discharging said photoconductive layer by exposing it to electromagnetic radiation to which it is sensitive, (iii) applying electrostatically charged oleophilic toner particles to develop the resulting electrostatic charge pattern either by positive or reversal development and (iv) fixing the toner to the photoconductive layer. Fixing is usually accomplished by the use of heat which causes the toner resin powder to coalesce and adhere to the photoconductive layer.

The copy sheet with the fused oleophilic image portions is then converted to a lithographic master by treatment with a conversion solution. The conversion step treats the photoconductive coating so that water receptive background areas are obtained. The ink receptive portions are the fused oleophilic toner images.

In second type of printing plate the toner image resulting from step (iii) is transferred from the photoconductive layer to a toner receiving plate on which the toner transfer image is then fixed. In this system the photoconductor can be reused after cleaning. The toner receiving plate does not need a photoconductive coating; any conventional lithographic coating will suffice. Depending on the coating used subsequent chemical treatment may be necessary to render the background areas water receptive.

A third method for electrostatographically producing printing plates is a Direct Electrostatic Printing (DEP) method, wherein electrostatic printing is performed directly from a toner delivery means on a receiving substrate, the latter not bearing any imagewise latent electrostatic image, by means of an electronically addressable printhead structure. After image-wise depositing and fixing of toner on said receiving substrate, it will serve as lithographic printing plate.

Several image receiving layers, applied on a substrate, for producing lithographic printing plates by non-impact printing have been disclosed.

An example of a toner receiving plate provided with a lithographic coating consisting of polyvinyl alcohol, tetraethyl orthosilicate, titanium dioxide and wetting agents is described in U.S. Pat. No. 3,971,660. However, printing plates obtained from these toner receiving plates applying conventional electrophotographic techniques do not yield the desired quality and resolution that can be obtained, for example, with lithographic printing plates, produced by wet methods as e.g. silver salt diffusion transfer processes.

In EP-A 405 016, a method for electrostatographically producing lithographic printing plates has been disclosed wherein dry toner particles of which more than 90% by volume have a particle size diameter less than 10 $\mu$m and more than 50% by volume have a particle size diameter less than 7 $\mu$m, are used and deposited on a receiving element comprising a plastic film support that is thermostable to a temperature of at least 140° C. and a cross-linked hydrophilic layer thereon, said layer containing infrared absorbing substances in such an amount that the reflection density of said layer in the visible spectrum is between 0.4 and 1.4. This method is said to produce lithographic printing plates with excellent lithographic properties that are dimensionally stable, that do not tear easily and that are capable of duplicating runs in the range of several tens of thousands of copies with good screen reproduction and substantially no fog or scumming.

In U.S. Pat. No. 5,123,920, a toner receiving plate comprising a thermoplastic film support and a cross-linked hydrophilic layer thereon, characterised in that the cross-linked hydrophilic layer of the toner receiving plate either carries on top thereof or incorporates spacing particles forming protuberances on said layer, said spacing particles having an average particle diameter at least twice the average particle diameter of the toner particles. Such a toner receiving element is said to have the advantage over the prior art receiving element that the transfer efficiency of fine toner particles is substantially increased. The use of fine toner particles being required for obtaining high resolution images.

In U.S. Pat. No. 4,686,138 a toner receiving layer for the electrostatographic production of a lithographic printing plate is disclosed, which comprises a water resistant support and an image receiving layer provided thereon which comprises a mixed pigment comprising a synthetic silica fine powder of 20 $\mu$m or less in particle diameter and a colloidal silica of 50 nm or less in particle diameter and a binder which is preferably polyvinyl alcohol. The resulting printing plate is said to have good fixability for printing inks and for toners copiers.

In JP-A 61/205190, an image receiving layer is disclosed with a surface roughness of 5 $\mu$m to 20 $\mu$m (Rmax under JIS-B-0601). It is said that the number of toner particles adhering to the non-picture portion of the receiving material can be reduced, thus reducing the background fog when the lithographic printing plate is used.

In EP-A 701 179 a sheet or web material with a photoconductive ZnO layer for the production of lithographic printing plates by electrophotographical means is disclosed. The layer comprises two kinds of matting agents. Such a material has the disadvantage that the presence of photoconductive ZnO is necessary for the process to work and that, by that need, the degrees of freedom in optimizing the quality of the lithographic printing plates produced on it are limited.

In EP-A 742 107 and DE-A 23 01 466 image receiving layers for use in electrophotographic processes are disclosed, but these disclosures remain silent on the possibility of using the electrophotographically produced images as lithographic printing plate.

In U.S. Pat. No. 4,420,528 a transfer film with a polysulphone resin and NOT carrying a toner receiving layer has been disclosed for replacing paper in an electrophotographic copier, but this disclosure again remains silent on the possibility of using the electrophotographically produced images as lithographic printing plate.

Although the toner receiving layers according to the art cited above are indeed useful for producing offset (lithographic) printing plates by electrostatographic means, further improvements are still desirable.

OBJECTS AND SUMMARY OF THE INVENTION

It is an object of the invention to provide an image receiving element, for use in non-impact printing, that can be used to form a lithographic printing plate, that makes it possible to print long runs, does have a very low background fog and that does smear very little ink in the offset press.

It is a further object of the invention to provide a toner receiving element that can be used in any electrostatographic printing system without the need of special precautions.

The objects of the invention are realized by providing an image receiving element, for use in non-impact printing, comprising a support and an image receiving layer thereon containing an hydrophilic binder, $TiO_2$ particles with average particle size between 0.1 $\mu$m and 1 $\mu$m, a matting agent and wherein said layer is cross-linked with an element selected from the group of hydrolysed tetramethyl silicate and hydrolysed tetraethylsilicate and wherein said $TiO_2$ particles and said hydrophilic binder are present in a ratio $TiO_2$/binder between 2.0 and 20, characterised in that said image receiving layer has an average surface roughness $R_a$ and a maximum roughness $R_t$ such that $R_a/R_t \geqq 0.080$.

Preferably said image receiving layer has an average surface roughness $R_a$ such that $R_a \geqq 1$ $\mu$m and a maximum roughness $R_t$ such that $R_a/R_t \geqq 0.10$.

More preferably said image receiving layer further has a kinetic friction coefficient $\mu_k$ against rubber with Shore Hardness 70, such that $\mu_k \geqq 0.85$.

The objects of the invention are further realized by providing a method for producing lithographic printing plates on an image receiving element of this invention by non-contact printing means using dry toner particles.

Further objects and advantages of the invention will become clear from the detailed description hereinafter.

DETAILED DESCRIPTION OF THE INVENTION

In the prior art several proposals for improvements in image (the wording "an image" means throughout this document text as well a pictures as well as markings (e.g. a bar-code) or combinations of these elements) receiving layers for use in the production of lithographic printing plates, by non-impact printing methods, have been made. Several disclosures recognize e.g. that the image receiving layer on a receiving element for use in the production of lithographic printing plates by non-impact printing methods, must have a certain roughness. It is e.g. disclosed as cited above that the surface roughness of a toner receiving layer should be of 5 $\mu$m to 20 $\mu$m, measured as $R_{max}$ under JIS-B-0601, or that the toner receiving layer should incorporate spacing particles forming protuberances on said layer, said spacing particles having an average particle diameter at least twice the average particle diameter of the toner particles. Most of the toner receiving layers now on the market make it possible to produce a lithographic printing plate by electrostatographic means, or by other non-impact printing methods (e.g. ink-jet printing, ionography, magnetography, etc), but are not very well suited for use without special plate preparation or the use of a special fountain to clean the background areas.

Herein after, the wording "toner receiving layer" is used to mean "an image receiving layer for use in non-impact printing methods, especially in electro(stato)graphic methods".

In the prior art disclosures on materials for producing lithographic printing plates, e.g. in EP-A 488 437 or its U.S. equivalent U.S. Pat. No. 5,213,920, JP-A 61/205190 and in EP-A 701 179 the importance of having a receiving layers with relatively high maximum roughness ($R_{max}$ or $R_t$) is stressed.

It was now further surprisingly found by these inventors that the relation between the average roughness ($R_a$) and the maximum roughness ($R_t$) of the toner receiving layer was even more important in receiving layers for the production of high quality printing plate with non-impact printing means that the value of $R_a$. It was found that a receiving layer with a kinetic coefficient of friction ($\mu_k$) as disclosed above, and further an $R_a$ and an $R_t$ such that $R_a/R_t \geqq 0.080$, could be used to produce a lithographic printing plate giving very low background fog and very little smearing of ink in the offset press. It was further preferred that a receiving layer, as described above, further had an $R_a \geqq 0.70$, more preferably $\geqq 0.85$. Very good results were obtained when the image receivng layer of an imagin gelement of this invention had an average surface roughness ($R_a$) such that $R_a \geqq 1$ $\mu$m and a maximum roughness $R_t$ such that $R_a/R_t \geqq 0.10$.

It was now further found that the quality of the printing plate produced on an image receiving element of this invention could furhter be enhanced by adjusting the kinetic coefficient of friction $\mu_k$ of the toner receiving layer measured against rubber having a Shore Hardness of 70 (rubber used in lithographic printing presses for elements repeatedly contacting the ink bearing side of the printing plate). This friction coefficient was very important for providing toner receiving layers on a toner receiving element that could be used for producing lithographic printing plates and that did give acceptable to very good printing results even when used without special plate preparation or cleaning of the background areas with a special fountain. It was found that when the toner receiving layer had a $\mu_k \geqq 0.85$, preferably a $\mu_k \geqq 0.90$ and even more preferably a $\mu_k \geqq 1.00$, printing plates with very good quality, especially regarding the smearing of ink on the rubber of the printing press, could be produced by non-impact printing means. The kinetic friction coefficient, $\mu_k$, was measured according to ASTM D1894 against a rubber having a Shore Hardness of 70.

In a very preferred embodiment of this invention, the toner receiving layer has a kinetic friction coefficient ($\mu_k$) against rubber, with Shore Hardness 70, $\geqq 0.9$ and an average surface roughness ($R_a$) such that $R_a \geqq 1$ $\mu$m and a maximum roughness $R_t$ such that $R_a/R_t \geqq 0.10$.

The profile of a toner receiving layer is measured with a perthometer MAHR PERTHEN S6P containing as measuring head RTK 50 (trade names of Feinpruef Perthen GmbH, Goettinger, Germany) equipped with a diamond stylus with a diameter of 5 μm under a pressure of 1.0 mN according to techniques well known in the art. The sampling length $L_s$ which is the reference length for roughness evaluation measures 0.25 mm. The evaluation length $L_m$, being that part of the traversing length $L_t$ which is evaluated for acquiring the roughness profile R contains standard 5 consecutive sampling lengths. The traversing length $L_t$ is the overall length travelled by the tracing system when acquiring the roughness profile. The maximum roughness depth $R_t$ is the perpendicular distance between the highest and the lowest point of the roughness profile R. The average roughness $R_a$ is the measured roughness averaged over the evaluation length $L_m$.

The physical properties above are realized by adding a matting agent to the toner receiving layer. This matting agent may be any matting agent known in the art. It can be hydrophobic starch sold under tradename DROFLO by Roquette National Chimie, Rue Patou 4, F-59022, Lille-Cedex, France. It can be untreated amorphous silica, e.g. the amorphous silica sold by Crossfield Chemicals, Warrington, Chesire, England under trade names CROSSFIELD WP2, CROSSFIELD HP 37, CROSSFIELD HP 39, CROSSFIELD HP 250, CROSSFIELD HP 260, CROSSFIELD HP 270, NEOSYL AC, NEOSYL GP, NEOSYL ET, NEOSYL LD, NEOSYL TS or an amorphous silica sold by W.R. Grace & C°, Grace Davison Division, Baltimore, Md., USA under the trade names, SYLOID 378 and SYLOID 622. It is highly preferred in the toner receiving layer of this invention to use amorphous silica ($SiO_2$) as matting agent. Also organic polymeric beads can be used as matting agent in a receiving layer according to this invention. When using organic polymeric beads as matting agent, it is preferred to use matting agents containing a nucleus of polymerized α,β ethylenically unsaturated monomers and an envelope of graft-polymers carrying hydrophilic groups. The nucleus of such organic polymeric beads can be cross-linked or not. Typical examples of such polymer beads have been described in e.g. U.S. Pat. No. 4,614,708, U.S. Pat. No. 5,252,445 and EP-A 698,625.

The matting agent has preferably a weight average diameter ($d_{v50}$) between 3 and 20 μm, more preferably between 5 and 16 μm, in a very preferred embodiment the matting agent used has a $d_{v50}$ between 7 and 14 μm. The matting agent is preferably added to the coating solution such that more than 100 mg/m$^2$, preferably more than 200 mg/m$^2$ but less than 350 mg/m$^2$ is present.

The toner receiving element of the present invention comprises a polymeric film support and a hydrophilic layer (preferably a cross-linked hydrophilic layer) thereon.

The hydrophilic layer contains a hydrophilic (co)polymer or (co)polymer mixture cross-linked by means of a cross-linking agent.

As hydrophilic (co)polymers may be used, for example, homopolymers and copolymers of vinyl alcohol, acrylamide, methylol acrylamide, methylol methacrylate, acrylic acid, methacrylic acid, hydroxyethyl acrylate, hydroxyethyl methacrylate or maleic anhydride/vinylmethylether copolymers. Also gelatin can be used as a hydrophilic binder in a toner receiving layer according to this invention. The hydrophilicity of the (co)polymer or (co)polymer mixture used is the same as or higher than the hydrophilicity of polyvinyl acetate hydrolysed to at least an extent of 60 percent by weight, preferably 80 percent by weight.

Examples of cross-linking agents for use to cross-link the hydrophilic layer are hydrolysed tetramethyl orthosilicate, hydrolysed tetraethyl orthosilicate, diisocyanates, bisepoxides, formaldehyde, melamine formol and methylol ureum, as well as titanate and zirconate compounds.

The coating is preferably pigmented with titanium dioxide of pigment size which typically has an average mean diameter in the range of about 0.1 μm to 1 μm. Apparently, the titanium dioxide may even react with the other constituents of the layer to form an interlocking network forming a very durable printing plate. The titanium dioxide may be coated with for example aluminium oxide or silica. Other pigments which may be used instead of or together with titanium dioxide include silica or alumina particles, barium sulfate, magnesium titanate etc. and mixtures thereof. By incorporating these particles in the cross-linked hydrophilic layer of the present invention the mechanical strength of the layer is increased and the surface of the layer is given a uniform rough texture consisting of microscopic hills and valleys, which serve as storage places for water in background areas.

Preferably, the cross-linked hydrophilic layer of the present invention comprises a hydrophilic, homogeneous reaction product of polyvinyl alcohol, hydrolysed tetra(m) ethyl orthosilicate and titanium dioxide.

The amount of cross-linking agent is at least 0.2 parts by weight per part by weight of hydrophilic (co)polymer, preferably between 0.5 and 2 parts by weight, most preferably 1 part by weight. The pigment is incorporated in an amount of between 1 and 10 parts by weight per part by weight of hydrophilic (co)polymer.

According to a preferred embodiment of the toner receiving element, the coating composition for the toner receiving layer is prepared by mixing together a dispersion of titanium dioxide in hydrolysed polyvinyl acetate, preferably the acetate marketed by Wacker Chemie GmbH, F.R. Germany, under the trade mark POLYWIOL WX, and optionally a dispersion of carbon black in hydrolysed polyvinyl acetate and by adding to the resulting dispersion hydrolysed tetra (m)ethyl orthosilicate. The amount of hydrolysed tetra(m) ethyl orthosilicate in the coating composition is an amount corresponding to between 5 and 60%, preferably between 15 and 30% by weight of tetra(m)ethyl orthosilicate based on $TiO_2$, the amount of polyvinyl alcohol is between 5 and 50%, preferably between 15 and 30% by weight based on $TiO_2$ and the amount of carbon black is between 1 and 10%, preferably about 4% by weight based on the amount of titanium dioxide. Preferably some wetting agents are added to the coating composition.

If carbon black is used in a receiving layer according to this invention, the type of carbon black that is used (acid or basic carbon black) is preferably tuned to the type of $TiO_2$ used in combination with the pH of the layer in order to obtain a stable coating solution. The dispersing agent that is used should preferably also be properly selected in this respect. For more particulars reference is made to U.S. Pat. No. 5,254,421.

The above described cross-linked hydrophilic background layer has the desired hardness and degree of affinity for water to provide a long running lithographic printing plate with excellent toner adhesion and plate durability. Preferably the coating composition for a toner receiving layer, according to this invention, comprises $SiO_2$, $TiO_2$ and polyvinylalcohol (PVA) and is applied to the support so that the toner receiving layer comprises between 0.5 and 1 g/m$^2$ of $SiO_2$, between 4.0 and 10.0 g/m$^2$ of $TiO_2$ and between 0.5 and 1.5 g/m$^2$ of PVA (limits included).

The coating composition of the toner receiving element can be applied (coated) on any support known in the art, e.g.

polymeric film, paper, flexible metal plates, etc, using any conventional coating method. A polymeric film support, e.g. a polyester such as a polyethyleneterephthalate, polyethylenenaphthalate, a polycarbonate, a polyphenylenesulfide, a polyetherketone or a cycloolephinic co-polymer support, has the advantage compared to a paper or polyethylene coated paper support that it does not tear that easily, that it is stronger and that it has a high dimensional stability.

Coating is preferably carried out at a temperature in the range of 30 to 38° C., preferably at 36° C.

The thickness of the cross-linked hydrophilic layer the toner receiving element of the present invention may vary in the range of 0.1 to 10 $\mu$m and is preferably 2 to 7 $\mu$m.

The plastic film support may be coated with a subbing layer to improve the adherence of the lithographic coating thereto. Between the support, whether or not subbed, and the hydrophilic cross-linked layer there may be provided a layer containing boric acid to advance the gelation of the polyvinyl acetate matrix.

A receiving layer according to the present invention is not only well suited as a receiving layer for dry toner particles, it can also beneficially be used to receive liquid electrostatic developers or ink-jet inks. When making a printing plate by ink-jet on a receiving layer according to this invention, it is preferred to use an oleophilic ink. When dry toner particles are used to produce a printing plate on a toner receiving element according to this invention, any toner particles known in the art can be used.

The present invention also encompasses methods for producing lithographic printing plates by non-contact printing means using a receiving layer according to this invention. The present invention is thus also concerned with a method for producing lithographic printing plates by electro (stato)graphic printing means comprising the steps of:

i) providing an image receiving element comprising a support and an image receiving layer wherein said image receiving layer has a kinetic friction coefficient ($\mu_k$) against rubber, with Shore Hardness 70, $\geqq$0.85, and
ii) image-wise depositing dry toner particles, either via an electrostatic latent image or via Direct Electrostatic Printing, on said image receiving layer, thus creating an image on a background, said image and said background having a different affinity for lithographic printing ink.

In this method the electrostatic latent image can be formed by uniformly electrostatically charging a photoconductive layer, by means of a corona-discharge, and image-wise discharging said photoconductive layer by exposing it to electromagnetic radiation to which it is sensitive, or by applying a charge image on a charge retentive surface by ionography. After developing this latent image with charged toner particles, the developed image is transferred to the toner receiving layer. Tuse this invention incorporates a method for producing lithographic printing plates by non-contact printing means comprising the steps of:

i) creating an electrostatic latent image on a latent image bearing element and developing it with dry toner particles thus creating a toner image,
ii) transferring said toner image to an image receiving element according to this invention, and
iii) fixing said toner image on said image receiving layer, thus creating an image on a background, said image and said background having a different affinity for lithographic printing ink.

This charged toner particles can be incorporated in a liquid electrostatographic developer as well as in a developer using dry toner particles. When using dry toner particles, it can be magnetic toner particles, used as a mono-component dry developer. It can also be non-magnetic toner particles, used in a non-magnetic mono-component developer or non-magnetic toner particles used in a two-(multi-)component developer in combination with magnetic carrier particles. It is preferred to use of non-magnetic toner particles used in a two- (multi-)component developer in combination with magnetic carrier particles for making printing plates on a receiving layer according to this invention. By using such a developer printing plates could be made that show extremely low fog, have low tendency to ink-smearing and can print very sharp images. The combination of a receiving layer according to this invention in a CHROMAPRESS (trade name of Agfa-Gevaert NV) electrophotographic printing press with a commercial, dedicated for use in said CHROMAPRESS) multi-component developer made it possible to produce very good offset printing plates.

In direct electrostatic printing the image on the toner receiving element is directly formed by a DC-field between a toner source and the toner receiving element. In this DC-field a flow of charged toner particles is formed from said toner source to said receiving element. This toner flow is image-wise modulated by image-wise modulating electric fields around printing apertures in a printhead structure. Thus this invention further incorporates a method for producing lithographic printing plates by non-contact printing means comprising the steps of:

i) creating a flow of toner particles from a means for delivering toner particles to an image receiving element according to any of claims 1 to 6,
ii) forming a toner image by image-wise depositing toner particles to said image receiving element through operation of a printhead structure that is coupled to means for image-wise modulating said flow of toner particles and that is interposed between said means for delivering toner particles and said image receiving element, and
iii) fixing said toner image on said image receiving layer, thus creating an image on a background, said image and said background having a different affinity for lithographic printing ink.

Although the toner receiving element according to the present invention can be a photoconductive element, it is highly preferred to use a non-photoconductive toner receiving element.

Any toner resin known in the art can be used for preparing toner particles useful in this invention. The toner resin may comprise polycondensation resins (e.g. polyesters, polyamide), addition polymers (e.g. styrene-acrylate resins), epoxide resins or mixtures of these. It is however beneficial to use toner particles comprising an oleophilic resin. The presence of waxes in the toner particles can be very beneficial for differentiating the affinity for ink between the toner image and the background.

Toner particles, used in toner compositions according to the present invention, can comprise any normal toner ingredient e.g. charge control agents, pigments both coloured and black, anorganic fillers, etc. A description a charge control agents, pigments and other additives useful in toner particles, to be used in a toner composition according to the present invention, can be found in e.g. EP-A 601 235. It can be negatively as well as positively chargeable tone particles.

Dry toner particles useful in the present invention can prepared by mixing the binder and ingredients in the melt phase, e.g. using a kneader. After cooling the solidified mass is crushed, e.g. in a hammer mill and the obtained coarse particles further broken e.g. by a jet mill to obtain sufficiently small particles from which a desired fraction can be separated by sieving, wind sifting, cyclone separation or other classifying technique. The actually used toner particles have preferably an average diameter between 3 and 20 μm determined versus their average volume, more preferably between 5 and 10 μm when measured with a COULTER COUNTER (registered trade mark) Model MULTISIZER particle size analyzer operating according to the principles of electrolyte displacement in narrow aperture and marketed by COULTER ELECTRONICS Corp. Northwell Drive, Luton, Bedfordshire, LC 33, UK. Suitable milling and air classification may be obtained when employing a combination apparatus such as the Alpine Fliessbeth-Gegenstrahlm ühle (A.G.F.) type 100 as milling means and the Alpine Turboplex Windsichter (A.T.P.) type 50 G.C as air classification means, available from Alpine Process Technology, Ltd., Rivington Road, Whitehouse, Industrial Estate, Runcorn, Cheshire, UK. Another useful apparatus for said purpose is the Alpine Multiplex Zick-Zack Sichter also available from the last mentioned company.

Toner particles for use in the present invention can also be spherical particles produced by the "emulsion polymerization" process, limited to the production of addition polymers, is described e.g. in U.S. Pat. No. 2,932,629, U.S. Pat. No. 4,148,741, U.S. Pat. No. 4,314,932 and EP-A 255 716. In this process a water-immiscible polymerizable liquid is sheared to form small droplets emulsified in an aqueous solution, and the polymerization of the monomer droplets takes place in the presence of an emulsifying agent. Initially the polymerizable monomers are in liquid form and only at the end of the polymerization a suspension of solid polymer particles in the aqueous phase is obtained.

Useful toner particles, for this invention, can also be produced by the "polymer suspension" process a pre-formed polymer is dissolved in an appropriate organic solvent that is immiscible with water, the resulting solution is dispersed in an aqueous medium that contains a stabilizer, the organic solvent is evaporated and the resulting particles are dried. Such a process is described in e.g. EP-A 725 317.

EXAMPLES

1. Coating of the Toner Receiving Layers

Receiving layer 1 (RL1)

To 773 g of an aqueous dispersion comprising 25% by weight of $TiO_2$ particles with average particle size between 0.3 and 0.5 μm and 2.5% by weight of polyvinylalcohol (hydrolysed polyvinyl acetate, marketed by Wacker Chemie GmbH, F.R. Germany, under the trade mark POLYWIOL WX), 184 g of an aqueous dispersion of hydrolysed tetramethylsiloxane (22% by weight of hydrolysed tetramethylsiloxane) was added. To this mixture, 25 g of an amorphous silica matting agent (CROSSFIELD WP2 trade name) with $d_{v50}$=13.27 μm (Coulter Counter MULTISIZER II, trade name) and wherein 80% of the particles have a particles size between 5 and 25 μm, was added, together with 25 ml of a saponine as wetting agent. The volume was adjusted with to 1,000 ml with distilled water. The pH was adjusted to 4.00 with NaOH.

This coating composition was applied to a heat-set, biaxilally oriented polyethylene terephthalate film with thickness 100 μm so that 0.25 g/$m^2$ of matting agent was present.

Receiving layer 2 (RL2)

The preparation of receiving layer 1 was repeated, except for the presence in the coating composition of 25 g hydrophobized starch with $d_{v50}$=14 μm, wherein 80% of the particles have a particle size between 10 and 30 μm, as matting agent (DROFLO trade name).

Receiving layer 3 (RL3)

The preparation of receiving layer 1 was repeated, except for the presence of 10 g of an amorphous silica matting agent (CROSSFIELD WP2 trade name) with $d_{v50}$=13.27 μm and wherein 80% of the particles have a particle size between 5 and 25 μm. This composition was coated such that 0.1 g of mating agent was present per $m^2$.

Receiving layer 4 (RL4)

The preparation of receiving layer 2 was repeated, except for the presence of 10 g hydrophobized starch with $d_{v50}$=14 μm, wherein 80% of the particles have a diameter between 10 and 30 μm, as matting agent (DROFLO trade name). This composition was coated such that 0.1 g of mating agent was present per $m^2$.

Receiving layer 5 (RL5)

The preparation of receiving layer 1 was repeated, except for the presence of 25 g of an amorphous silica matting agent with $d_{v50}$=10 μm, wherein 80% of the particles have a diameter between 3 and 22 μm (NEOSYL GP trade name). This composition was coated such that 0.25 g of mating agent was present per $m^2$.

Receiving layer 6 (RL6)

The preparation of receiving layer 1 was repeated, except for the presence of 25 g of talcum with $d_{v50}$=10 μm, wherein 80% of the particles have a diameter between 3 and 23 μm. This composition was coated such that 0.25 g of mating agent was present per $m^2$.

Receiving layer 7 (RL7)

The preparation of receiving layer 1 was repeated, except that NO matting agent was present.

The $R_a$, the ratio $R_a/R_t$ and the coefficient of friction $\mu_k$ for each the receiving layers are summarized in table 1.

3. Preparation of the Printing Plates

In a XANTHE PLATEMAKER 8200 (trade name of Xanthe USA) printing plates were prepared using each of the receiving layers above (RL1 to RL6). In this plate maker a commercially available (Trough CANON KK, Japan) monocomponent magnetic developer with toner particles having a $d_{v50}$ around 6.5 μm, comprising carbon black and $Fe_xO_y$ as magnetic pigment, is used to form the image on the respective receiving layers.

4. Testing of the Printing Plates

The six printing plates (made on RL1 to RL6) were used for lithographic printing on paper in a ABD 9860 press with ABD 1020 ink (both ABD 9860 and ABD 1020 are trade names of AB Dick, USA).

The printing proceeded without the use of any fountain or printing plate preparation fluid.

The printing quality on the paper was judged by the fog due to ink-smearing (ISF). The measurement of ISF proceeds as follows: The printing plate was used to print 250 sheets of paper. These 250 sheets of paper were shorter than the printing plate, so that ink can accumulate on the rubber roller of the printing press. After the 250 shorter sheets, the printing proceeded on paper sheets with the same length as the printing plate. On the first sheets, with the same length as the printing plate, the reflection density in the area of maximum background density was measured. Thus the smaller figure the better the printing plate. A value below 0.20 is considered to be acceptable, a value below 0.15 to be good and a value equal to or lower than 0.10 is considerd to be very good.

The results are summarized in table 1.

TABLE 1

| RL | Type | Amount g/m$^2$ | $\mu_k$ | $R_a/R_t$ | $R_a$ | ISF |
|---|---|---|---|---|---|---|
| RL1 | 1 | 0.25 | 1.05 | 0.110 | 1.5 | 0.06 |
| RL2 | 2 | 0.25 | 1.03 | 0.083 | 1.0 | 0.10 |
| RL3 | 1 | 0.10 | 1.01 | 0.089 | 0.9 | 0.12 |
| RL4 | 2 | 0.10 | 1.03 | 0.085 | 0.7 | 0.18 |
| RL5 | 3 | 0.25 | 1.00 | 0.080 | 0.7 | 0.08 |
| RL6 | 4 | 0.25 | 0.87 | 0.123 | 1 | 0.14 |
| RL7 | n.a. | 0 | 0.84 | 0.066 | 0.7 | 0.30 |

RL = release layer
Type: type of matting agent: 1 = CROSSFIELD WP2 (trade name) amorphous silica, 2 = DROFLO (trade name) hydrophobized starch, 3 = NEOSYL GP (trade name) amorphous silica, 4 = talcum
Amount: amount of matting agent
$R_a$, $R_a/R_t$ and $\mu_k$ as defined in the text.
ISF: reflection density of fog due to ink smearing (smaller figure better).
n.a.: not applicable It is claimed:

1. An image receiving element, for use in non-impact printing, comprising a support and an image receiving layer thereon containing an hydrophilic binder, $TiO_2$ particles with average particle size between 0.1 $\mu$m and 1 $\mu$m, a matting agent and wherein said layer is cross-linked with an element selected from the group of hydrolyzed tetramethyl silicate and hydrolyzed tetraethylsilicate, wherein said $TiO_2$ particles and said hydrophilic binder are present in a ratio $TiO_2$/binder between 2.0 and 20, and wherein said image receiving layer has an average surface roughness $R_a$ and a maximum roughness $R_t$ such that $R_a/R_t \geqq 0.080$.

2. A image receiving element according to claim 1, wherein said image receiving layer has an average surface roughness $R_a$ such that $R_a \geqq 1$ $\mu$m and a maximum roughness $R_t$ such that $R_a/R_t \geqq 0.10$.

3. A image receiving element according to claim 1, wherein said image receiving layer further has a kinetic friction coefficient $\mu_k$ against rubber with Shore Hardness 70, such that $\mu_k \geqq 0.85$.

4. An image receiving element according to claim 2, wherein said image receiving layer further has a kinetic friction coefficient $\mu_k$ against rubber with Shore Hardness 70, such that $\mu_k \geqq 0.85$.

5. An image receiving element according to claim 1, wherein said matting agent is present in an amount between 0.1 g/m$^2$ and 0.35 g/m$^2$, both limits included.

6. An image receiving element according to claim 1, wherein said matting agent is an amorphous $SiO_2$.

7. An image receiving element according to claim 6, wherein said amorphous $SiO_2$ has an average particle size $d_{v50}$ such that 7 $\mu$m $\leqq d_{v50} \leqq$ 14 $\mu$m.

8. A method for producing lithographic printing plates by non-contact printing means comprising the steps of:

i) creating an electrostatic latent image on a latent image bearing element and developing it with dry toner particles thus creating a toner image, ii) transferring said toner image to an image receiving element comprising a support and an image receiving layer thereon containing an hydrophilic binder, $TiO_2$ particles with average particle size between 0.1 $\mu$m and 1 $\mu$m, a matting agent and wherein said layer is cross-linked with an element selected from the group of hydrolysed tetramethyl silicate and hydrolysed tetraethylsilicate and wherein said $TiO_2$ particles and said hydrophilic binder are present in a ratio $TiO_2$/binder between 2.0 and 20, and iii) fixing said toner image on said image receiving layer, thus creating an image on a background, said image and said background having a different affinity for lithographic printing ink.

9. A method according to claim 8, wherein said image receiving layer has an average surface roughness $R_a$ such that $R_a \geqq 1$ $\mu$m and a maximum roughness $R_t$ such that $R_a/R_t \geqq 0.10$.

10. A method for producing lithographic printing plates by non-contact printing means comprising the steps of:

i) creating a flow of toner particles from a means for delivering toner particles to an image receiving element comprising a support and an image receiving layer thereon containing an hydrophilic binder, $TiO_2$ particles with average particle size between 0.1 $\mu$m and 1 $\mu$m, a matting agent and wherein said layer is cross-linked with an element selected from the group of hydrolysed tetramethyl silicate and hydrolysed tetraethylsilicate and wherein said $TiO_2$ particles and said hydrophilic binder are present in a ratio $TiO_2$/binder between 2.0 and 20, ii) forming a toner image by image-wise depositing toner particles to said image receiving element through operation of a printhead structure that is coupled to means for image-wise modulating said flow of toner particles and that is interposed between said means for delivering toner particles and said image receiving element, and iii) fixing said toner image on said image receiving layer, thus creating an image on a background, said image and said background having a different affinity for lithographic printing ink.

11. A method according to claim 10, wherein said image receiving layer has an average surface roughness $R_a$ such that $R_a \geqq 1$ $\mu$m and a maximum roughness $R_t$ such that $R_a/R_t \geqq 0.10$.

* * * * *